United States Patent [19]

Talanker

[11] Patent Number: 5,003,895

[45] Date of Patent: Apr. 2, 1991

[54] EMBROIDERY PANTOGRAPH ASSEMBLY

[76] Inventor: Lev Talanker, P.O. Box 240458, Brooklyn, N.Y. 11224-0458

[21] Appl. No.: 157,614

[22] Filed: Feb. 19, 1988

[51] Int. Cl.[5] ..... D05C 5/02; D05B 21/00

[52] U.S. Cl. ..... 112/103; 112/121.12

[58] Field of Search ..... 112/103, 121.12, 262.3, 112/266.1, 121.11, 102, 86, 78

[56] References Cited

U.S. PATENT DOCUMENTS

| | | | |
|---|---|---|---|
| 3,750,186 | 7/1973 | Sakamoto | 112/121.12 X |
| 4,152,994 | 5/1979 | Sugiyama | 112/121.12 |
| 4,365,565 | 12/1982 | Kawai et al. | 112/103 |
| 4,598,655 | 7/1986 | Takenoya | 112/103 |
| 4,627,369 | 12/1986 | Conrad et al. | 112/103 |

*Primary Examiner*—Peter Nerbun

[57] ABSTRACT

An embroidery pantograph assembly comprises first and second movable plates driven in mutually perpendicular directions by a pair of stepping motors and a workpiece holding assembly mounted on the second movable plate and driven thereon in mutually perpendicular directions by third and fourth stepping motors. The first and second plates are moved over relatively large distances by the first and second stepping motors while the workpiece holding assembly is movable over relatively small distances on the second movable plate by the third and fourth stepping motors to effect fine embroidery on a small operating scale.

3 Claims, 3 Drawing Sheets

EMBROIDERY PANTOGRAPH ASSEMBLY

BACKGROUND OF THE INVENTION

This invention relates to a numerically controlled embroidery machine having a work piece held by a hoop, or a clamp, and moved under a sewing head on an X-Y table which is driven along two perpendicular coordinate axes by two stepping motors; the said motors rotate to produce a predetermined pattern that is recorded within a computer memory; the said memory controls the stepping motor motion at the times the embroidery needle is out of working piece to be embroided.

Similar machines are described in the following U.S. Pat. Nos. 4,050,393 by Welcher et al.; 4,069,778 by Kozawa; 4,135,459 by Manabe et al.; 4,152,994 by Sugiama; 4,325,313 and 4,365,565 both by Kawai et al.; 4,444,134 by Matuyama et al.; 4,622,907 by Kimura.

Specifically, this invention relates to those parts of an embroidery machine that position material of a work piece, under a machine head, in a predetermined embroidery pattern. Contained in the above cited U.S. Patents there is described a set of embroidery machines. There are some improvements on the material feed mechanism for the said machine. The said mechanism in many cases is called a Pantograph.

The following patents describe the said pantographs: U.S. Pat. Nos. 4,186,673 by Vartoukian; 4,187,794 by Ross; 4,195,581 by Ohara; 4,444,133 by Bolldorf et al.; 4,598,655 by Takenoya.

In several patents one can see an intent to create a low inertia means to move the work piece with high speed during an embroidery process. For example, as it is described in U.S. Pat. No. 4,186,673 by Vartoukian. For this purpose, in several patents, stepping motors, are used to move a work piece in X-Y directions. The motors are rigidly attached to the machine frame, and the output motion of the stepping motors is transferred to a work piece mounted on a hoop by a wire running around a set of rollers. That arrangement is shown in units; U.S. Pat. No. 4,135,459 by Manabe et al.; in U.S. Pat. No. 4,186,673 by Vartoukian; in U.S. Pat. No. 4,201,144 by Manabe et al.; in U.S. Pat. No. 4,325,313 by Kawai et al.; in U.S. Pat. No. 4,598,655 by Takenoya.

Also, some patents show large and heavy pantographs to cover a big embroidery area. That is shown in U.S. Pat. No. 4,152,994 by Sugiama, in U.S. Pat. No. 4,444,133 by Bolldorf; in U.S. Pat. No. 4,495,876 by Tajima; and in U.S. Pat. No. 4,627,369 by Conrad et al.

A system to control embroidery stepping motors according to an embroidery pattern design and having the said pattern design recorded within a computer memory exists. Futhermore, systems exist which are capable of working with synchronization of other mechanical systems. These systems are applied to a number of different kind of pantographs with minor adaptations. These systems are described in the U.S. Pat. Nos. 4,152,994 by Sugiama; 4,309,950 by Franklin; 4,325,315 by Totino et al.; 4,526,116 by Mannel; 4,498,403 by Yanagi et al.; 4,683,827 by Kinoshita; 4,692,871 also by Kinoshita. The said systems use electronic computers to control mechanical output, hence very little time is required for any operational change to move a piece of work under a needle regardless of embroidery area involved, and also regardless of the desired quality of the embroidery pattern. The embroidery speed and/or embroidery quality in most cases is limited by deficiencies in mechanical assemblies engaged between stepping motors, from one side, and an embroidery hoop holding a piece of work to be embroided, from another side.

To demonstrate this, let us consider, first, all pantographs with wire transmission. Positively all of them must use a set of idling and direction control rollers; these rollers being dynamically rotated in both directions will increase inertia of machinery kinematics. This, causes the average speed of an embroidery operation to diminish. A wire works only for tension, being unable to transfer compressive force. By this reason, a wire working as a mechanical transmission device takes at least twice the length that would be needed by a solid unflexible linkage to transmit the same reciprocated motion. A wire causes a noticeable backlash during reciprocation, because the part of the wire transmission system under tension moves the hoop, while the idling part of the wire loop is generally free of any tension in order to minimize forces on the roller axes and thus prevent any significant increase of friction forces. In a large pantograph a wire transmission mechanism could create jolts and jiggling which is unacceptable for fine embroidery operation. Generally, small pantographs operating at slow speeds may employ a wire transmission.

As long as the embroidery industry grows, an increase in speed and range of embroidery operation will be a matter of competition in the specialized machinery market. Currently, some available embroidery pantographs having screw-and-nut couplings to transfer rotating motion into reciprocating motion look more promising for future embroidery machines than pantographs with a wire on rollers. Pulley-and-timing belt couplings may also be successfully utilized. Gear wheels with rack-and-pinion coupling also looks much better than a wire on rollers and pulleys. These types of pantographs are disclosed in the U.S. Pat. Nos.: 4,069,778 by Kozawa; 4,152,994 by Sugiama; 4,44,133 by Bolldorf et al.; 4,444,134 by Maruyama et al.; 4,627,369 by Conrad et al.

Let us consider, next, the second type of pantograph, having no wire as means of transmission. We have to notice that a requirement for a fine embroidery operation calls for a very small clearance between meshed transmission parts, however, small clearances create objectionable friction forces between the meshed parts. For a large operational area it is more desirable to have a low friction transmission. Thus, the market place should be highly receptive to a precision low friction embroidery mechanism. This is the first objective of this current invention.

As previously mentioned, all pantographs without a wire transmission have one stepping motor fixed to a immovable plate, and the second stepping motor fixed to a moveable plate; the moveable plate being driven by a transmission from the first stepping motor. This arrangement creates excessive weight and inertia within the moveable plate which must be overpowered by the first stepping motor during an embroidery operation.

The second purpose of the current invention is to allow the second stepping motor to be fixed to a moveable plate which results in a light and low inertia benefit for all parts that are fixed to the moveable plate of the pantograph assembly.

SUMMARY OF THE INVENTION

According to the invention, the feeding device for a numerically controlled embroidery machine is accomplished by two interconnected X-Y tables, where each X-Y table is engaged by two stepping motors. The first table having long range mechanical transmission carries the second X-Y table which provides motion for a local embroidery area. The second X-Y table is smaller than the first with a short range mechanical transmission for fine embroidery on a small operating scale. The small table carries a hoop, or any other holding device, to feed the work piece under an embroidery needle.

A screw-and-nut connection within the first band assembly provides long range motion. There is sufficient clearance between the two members of the meshed transmission coupling involved to allow low friction motion in reciprocated directions at high speeds. The said speed being acceptable only for positional location of the second band.

Thus the first band is not employed directly to produce a fine embroidery pattern on the work piece held by a hoop. During fine embroidery operation the hoop is moved only by the second band transmission, however the hoop can be moved from one area to another by the first band transmission together with all the parts of the second band assembly having a hoop as a part of the second band assembly.

Both screw-and-nut couplings of the first band transmission are provided with lock nuts which may be rotated around the driving screws of each X-Y table by mechanical linkages from two positional actuators controlled by the same computer according to the program supplied in it's memory. In a locked position the said nuts are pressed to adjacent faces of the lead nuts in a way that no backlash is allowed in X-Y directions. During this time the first band is unshakeably fixed to the machine table, thus the fine embroidery operation can be performed by the second band assembly in the local area covered by short range transmission. As soon as local embroidery operation is finished, both lock nuts are turned free by their same actuators to allow any backlash inherent in the driving screw and lead nuts of the first band, then the computer gives to both stepping motors a pre-recorded amount of electrical impulses to move the second band into the next local embroidery area. In this place the lock nuts are going to be engaged to eliminate backlash until the next embroidery operation is finished by the second band, and so on.

The second band assembly is fixed to a lead nut of the first band assembly. Second band assembly has two stepping motors fixed to the base plate of the second band. The first stepping motor of the second band drives a moveable frame back and forth over a short range. Motion of this frame is controlled by a drive screw-and-lead-nut coupling with a very precise clearance to ensure a fine embroidery quality within a local area. The second moveable frame rides on two rods connected to a central block with a bracket. A hoop is attached to the bracket to hold the work piece under the embroidery needle. The central block can reciprocate on the supporting rods which have a ball bushing installations between its body and the said rods. The bottom part of the central block is driven by a timing belt supported on two pulleys. The idling pulley has a hole in it's axis with free clearance for the driving screw at a point where the said screw is coming out from a mating leading nut. An idling pulley is reciprocatingly driven in X direction by two cheeks of the moveable block. The other pulley has a shaped hole in its center to form a sliding coupling with a mating driving shaft that supports the said pulley, and also rotates the said pulley at any place along the shaft's body as long as the shaft is driven by the second stepping motor of the second band assembly.

The invented device is intended to be installed in a computer controlled embroidery machine. Both lock nut actuators and all four stepping motors must be interfaced with a power supply unit. The power supply unit is controlled a computer containing all timing of commands to insure the embroidery operation according to a chosen specific pattern, and also in synchronization with the operational performances of all other units of the machine involved.

The embodiment of this invention and its use in conjunction with any particular machine may vary. The preferred configuration is disclosed below in details, however, others are thought to be predicted by the description given in the claims.

DETAILED DESCRIPTION OF PREFERRED EMBODIMENT

Figure 1:
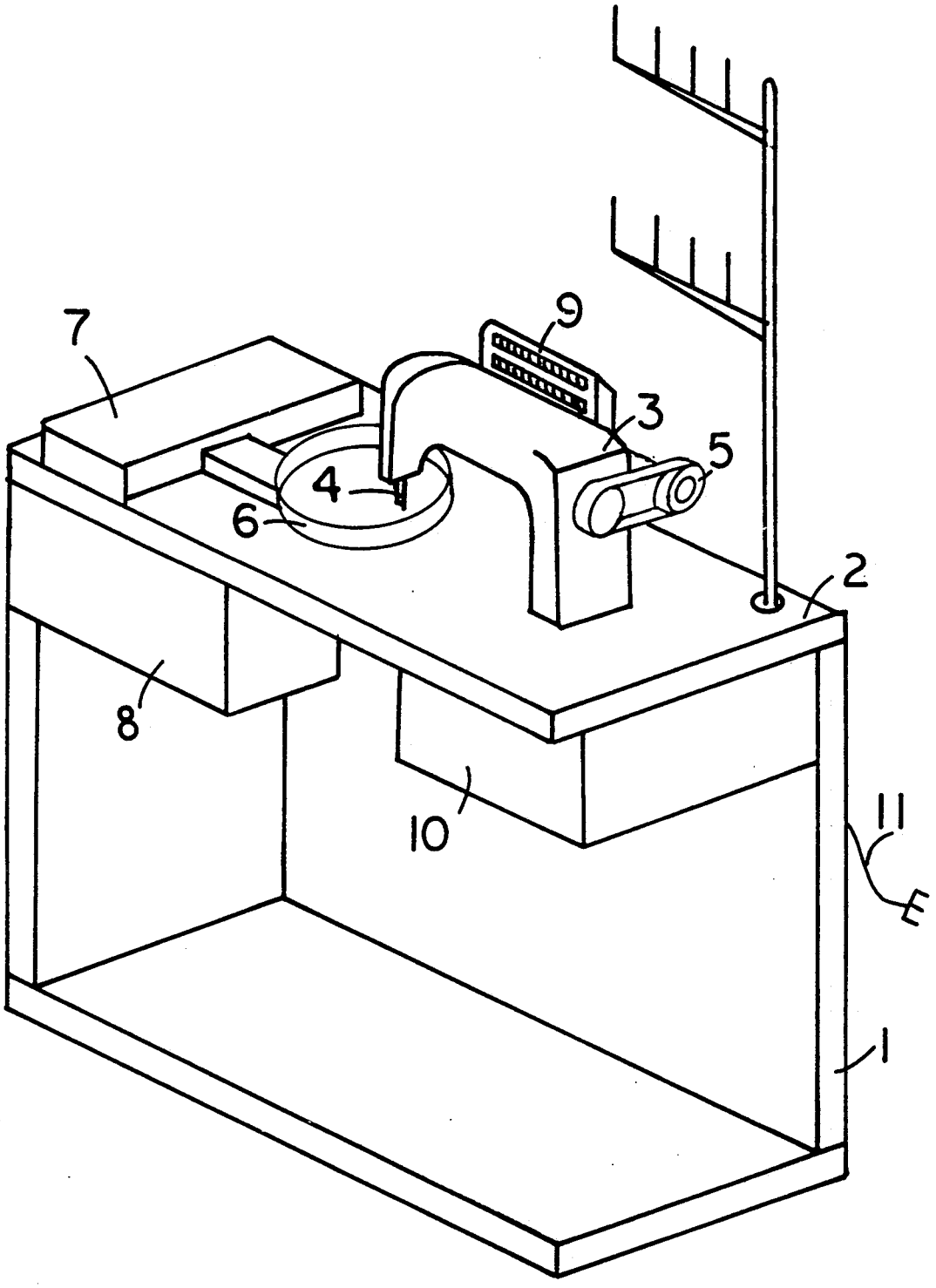
FIG. 1 - General Layout of Automatic Embroidery Machine

The drawing of FIG. 1 represents a general layout of a computer controlled embroidery machine.

Table 1 with working plate 2 bears a machine head 3 having a needle bar 4, and driving motor 5. Hoop assembly 6 is rigidly attached to a central movable block of a machine pantograph (not shown). Cover 7 is screening a pantograph bracket extended from the central block to the hoop assembly 6. Pantograph 8 is rigidly attached to the plate 2. Computer 9 together with it's keyboard is mounted as a whole unit on top of machine head 3. Power supply box 10 is mounted under plate 2 of table 1; the power supply has an interface with all power units, with computer 9, and with a service power line, being connected with the said service line by cable 11.

The embodiments of the invented device may be used with a variety of embroidery machines, including but not limited to those having more than one embroidery needle, more then one head, or having a different layout of main assemblies.

Figure 2:
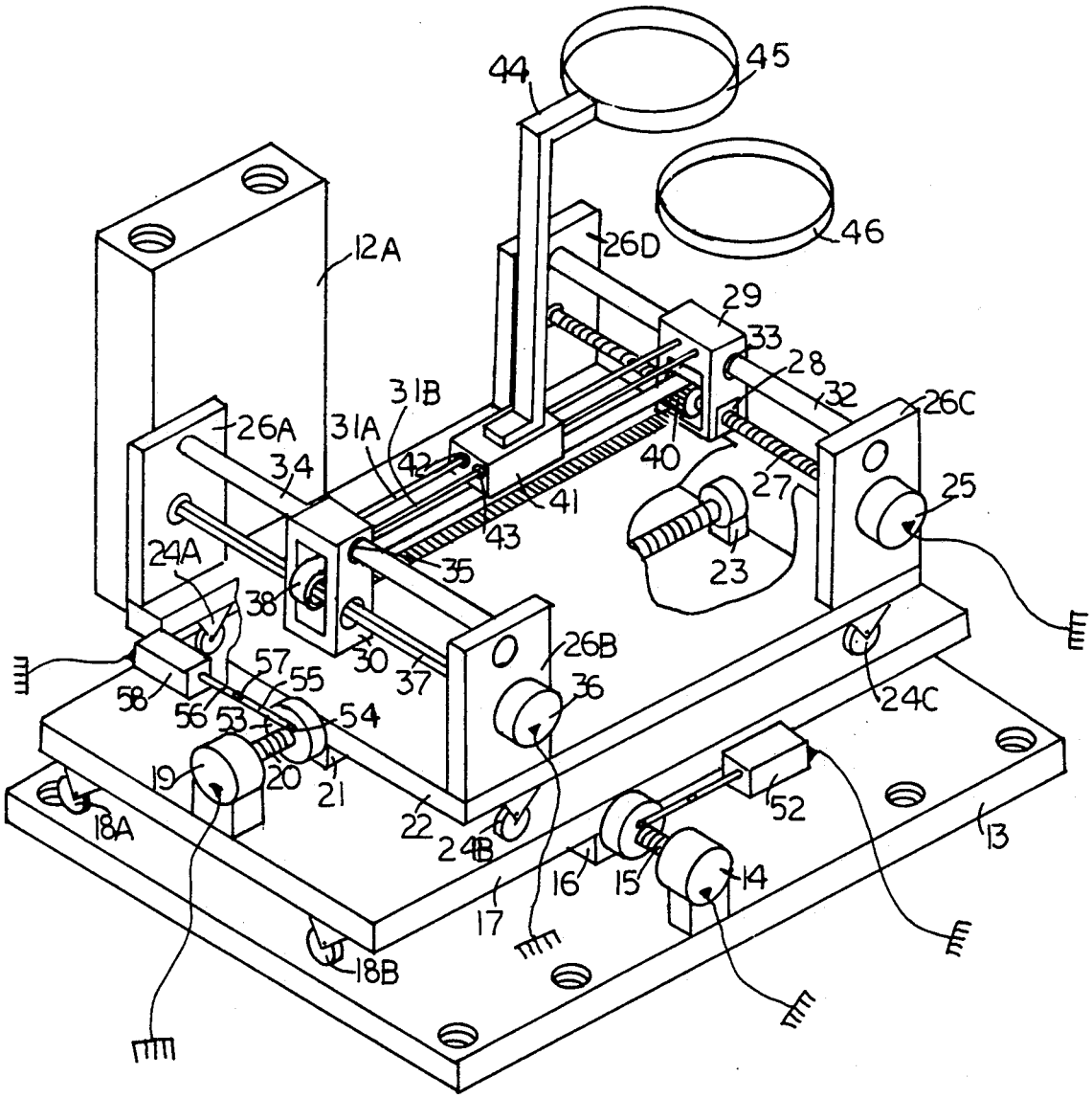
FIG. 2 - Perspective View of X-Y Feeding Device

Referring to FIG. 2, mounting plate 12A is fixed by two bolts and nuts to the bottom plane of table 2, as well as to the top plane of the immovable plate of the first band assembly—13. Mounting plates 12B, 12C, and 12D are not shown on FIG. 2, the said set of mounting plates is used to join the pantograph to the machine table 2.

The first stepping motor 14 is fixed to the immovable plate 13. This motor is connected to the first driving screw 15 so that the said screw can be forced to rotate in both directions.

Driving screw 15 is coupled with a lead nut 16. Lead nut 16 is fixed to the moveable plate 17. Stepping motor 14 is mounted on a base rigidly attached to plate 13 to provide clearance for motion of driving screw 15 and nut 16. Driving screw 15 at the remote end has another support fixed to plate 13. This support is not shown. Stepping motor 14 can drive the screw 15, thus forcing the lead nut 16 to reciprocate along axis X together with the moveable plate 17 that is supported by four rollers. Three of those rollers are designated as 18A, 18B and 18C; roller 18D is not shown.

The second stepping motor 19 is fixed to the movable plate 17. This motor is connected to the second driving screw 20. Driving screw 20 is coupled with second lead nut 21. Lead nut 19 is fixed to plate 22 of the second band assembly. On the remote edge of plate 17, directly opposite the place where the second stepping motor 19 is attached to the moveable plate 17, a support is provided. This support 23 allows free rotation for driving screw 20. Stepping motor 19 can drive the screw 20 in both directions, thus forcing the nut 21 together with the plate 22 to move back and forth along the axis of driving screw 20, while four support rollers like 24A, 24B, 24C (24D is not shown) will allow the plate 22 to move along Y direction in a reciprocated way.

The third stepping motor 25 is fixed to the mounting plate 26C; the said plate 26C is fixed to plate 22. Plate 22 can move in both X-Y directions with respect to the immovable plate 13. However, plate 22 can be firmly fixed with respect to plate 13 either by a null input to stepping motor 14 and 19, or by special lock nuts as described below.

The third stepping motor 25 is connected to the third driving screw 27. Driving screw 27 is coupled with a lead nut 28. Lead nut 28 is fixed to the small movable frame comprising movable block 29, movable block 30, and two parallel rods 31A and 31B, the said rods are fixed to both blocks 29 and 30 thus making a rigid contruction in the form of a rectangular frame.

A plate 26D, similar to the stepping motor mounting plate 26C, is mounted at the remote end of drive shaft 27. This plate houses a bearing to support drive shaft 27. The screw 27 can be rotated by stepping motor 25, thus forcing movable block 29 to go back and forth along the axis of driving screw 27, while the rod 32 provides a support for motion of block 29. A ball bushing 33, or other antifriction installation may be used between solid bodies of rod 32 and block 29. Block 30 comprises a movable frame supported by a rod 34 that is fixed between supports 26A and 26B. A bushing 35 can be applied between the parts 34 and 30 in the same way as the bushing 33 is applied between the parts 32 and 29 to reduce friction forces.

The fourth stepping motor 36 is fixed to the mounting plate 26B which is attached to the small plate 22. A square drive shaft 37 is connected to the fourth stepping motor 36. A square cross section is shown on FIG. 2 for the body of driving shaft 37, however many other forms would also be appropriate.

On the other edge of the small base plate 22, drive shaft 37 is rotatably supported by the mounting plate 26A. A toothed pulley 38 is rotated by the shaft 37 which is driven by the stepping motor 36. For this purpose, pulley 38 has in its center a hole matching the configuration of shaft 37 cross section. The pulley 38 can be easily moved along the said shaft 37 having a sliding clearance with the shaft. Any antifriction installation between the two coupled bodies can be applied as long as minimum backlash requirements for transmission are met. The exact location of pulley 38 along the shaft 37 is controlled by the forked part of movable block 30. The said forked part has a hole through it for free rotation of shaft 37, however, the pulley hub must be large enough to prevent escape through the said holes, thus keeping pulley 38 inside block 30. Two thrust bearings may be applied between the hub and body of block 30 from both sides of pulley 38 as antifriction devices (not shown).

A timing belt 39 rotates around pulleys 38 and 40. The pulley 40 is captured within the movable block 29, and it is rotatably supported by a tubing coming through the center of pulley 40. The said tubing (not shown) is fixed between the forked part of box 33. The tubing inside pulley 40 is big enough to allow a free pass with some dependable clearance for driving screw 27. Thus, the screw 27 has no direct contact with the pulley 40. However, the screw 27 is coupled with lead nut 28, and lead nut 28 is fixed to box 29. Driving screw 27, being rotated by stepping motor 25, can move box 29 along it's axis (in the direction of axis X). Box 29 consists of the following set of parts: lead nut 28, pulley 40 together with timing belt 39, and also together with all the other parts mounted on movable frame: 31A, 31B, 30, 35, and 38.

Central block 41 has two holes through for mounting on two rods 31A, and 31B with a sliding clearance, and a pair of ball bushings 42 and 43 installed inside body of block 41 to minimize the friction during motions of block 41 along rods 31A and 31B (motion is along the Y axis).

Block 42 has an immovable connection with bracket 44, that in turn is fixed to the outer ring 45 of the hoop assembly. The inner ring 46 mates with the hole inside the ring 45 with a clearance adjusted for the particular work piece to be fixed between the said rings.

The bottom plane of central box 41 is coupled with the top loop of timing belt 39, and this connection allows belt 39 to move the central block 41 together with bracket 44, and with hoop 45 holding a work piece (not shown). The said motion is generated by stepping motor 36, which is transferred to timing belt 39 by driving shaft 37, and by the pulley 38.

Figure 3:
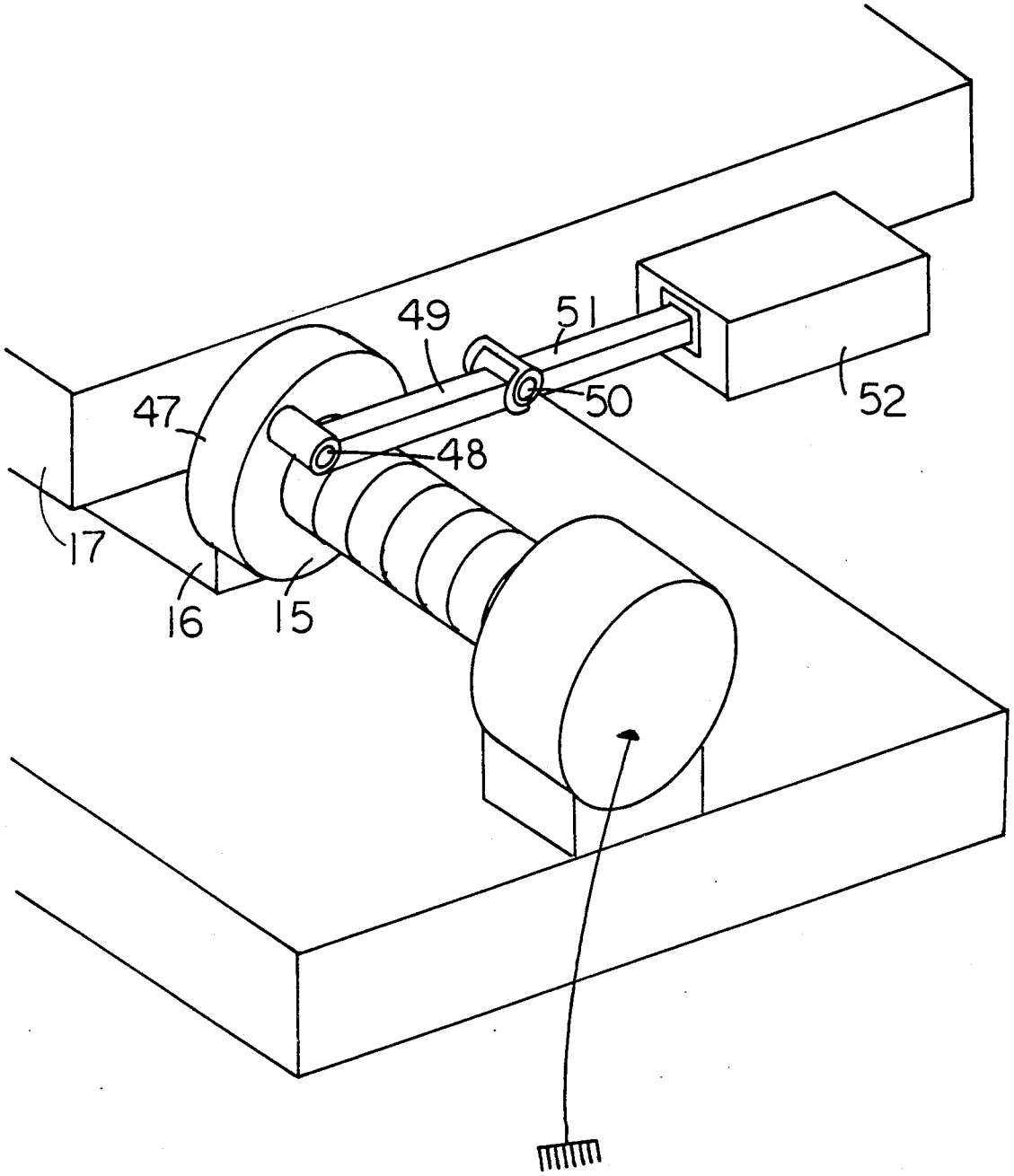
FIG. 3 - Perspective View of Lock Nut Assembly

Referring to FIG. 3, 17 shows a part of the big movable plate within the first band assembly. Lead nut 16 is fixed to plate 17, as it is also shown on FIG. 2. The first stepping motor 14 is fixed on the immovable plate 13, and it is also connected with the first driving screw 15. Lock nut 47 is coupled with the screw 15 in such a way that some clearance between the lead nut 16, and the lock nut 47 is provided. This clearance is sufficient for free and easy motion of driving screw 15 inside the two bodies of parts 16 and 47 when the screw 15 is rotated in either direction.

The nut 47 has an extended axis 48 to be fixed rotatably to a rod 49. The rod 49 is coupled by a connection element 50 with a movable rod 51, and the rod 51 is driven in or out of case 52 by a positional actuator (not shown). The case 52 is fixed to the plate 17. A sufficient clearance is arranged between nut 47 and nut 16 as long as the rod 59 is extended. No clearance between nuts 47 and 16 is provided at the time the rod 50 is retracted.

Referring again to FIG. 2, a lock nut 53 has an extended pin 54 serving as a coupling with the rod 55. The rod 55 is coupled with a retractable rod 56, and the common axis 57 is used between the two. Case 58 houses a positional actuator for the second driving screw 20. Case 58 is fixed to the plate 22.

parts 14 ,19, 25, 36, 52 and 58 have regular electric cables and terminals to be interfaced with power supply box 10, controlled by computer 9 (see FIG. 1).

The other embodiments of the disclosed invention may have a variety of different combinations in which driving screw-and-lead-nut transmission could be changed for a timing belt on two pulleys, or vice versa.

Any additional gears or timing belt-and-pulley transmission could be installed between one, or more stepping motors and driving screws. Support rollers 18 in some or in all cases may be changed by ball bushings on a support shaft or on a rail, and vice versa. Any embroidery machine may be adapted for use with the disclosed device, including but not limited to those with several heads, and those having several needles on each head. A machine layout may be changed, including, however, not limited to those utilizing more than one enclosure separated by a free space.

Any kind of computer, power supply, and any electrical or electronic interfaces may be used in conjunction with disclosed apparatus.

OPERATION

The invented device is operated by electrical power distributed from power supply box 10 by computer 9 in the way it timely runs each or all four stepping motors 14, 19, 25, and 36 (FIG. 2), switching on and off the driving motor 5 (FIG. 1), and/or engaging and disengaging actuators 52, and 58 of lock nuts 47 and 53 (FIGS. 2 & 3). Some positional sensors may be installed to facilitate feed-back operational features, and additional power units could be in control from computer and from sensors to insure safety of operation, including but not limited to the interruption of an automatic process that is described below.

A sequence and a period of operation of embroidery machine power units is predetermined by a computer memory to allow an embroidery pattern to be worked out on a piece of material which is held between rings 45 and 46 of the hoop assembly that is moved under the head 3 by the invented device 8, (FIG. 1). A specific design, must be pre-recorded into the computer memory.

A set of methods to write commands into the computer memory for automatic embroidery operation is disclosed in several units of previous Art that are specifically listed above starting from the U.S Pat. No. 4,309,950 by Franklin, and finishing by U.S. Pat. No. 4,692,871 by Kinoshita. Adaptation of those methods for the device disclosed herein is not a part of current invention as far as this invention is limited to those mechanical system that are responsible to facilitate only embroidery feeding operation.

Let's assume that a name INDEPENDENT SCIENCE COMPANY is chosen to be embroided as a monogram on a work piece, and this name is broken into three lines. The embroidery process is to follow English writing directions by going from left to right, and from top to bottom of any letter, as well as any line, or any text.

Let's assume that the area to bear the would be monogram is established within the operational range of the device, the size of letters is chosen within the range of operation of second band assembly, and the machine computer has precalculated the best spacing between all letters in each line, as well as the best interval between the lines. At this moment, an operator starts the embroidery operation according to the intended pattern of monogramming the said name: INDEPENDENT SCIENCE COMPANY.

All four stepping motors are continually directed by the computer 9 to place the left top part of the embroidered area at the spot where the letter "I" should be located. As soon as this spot is exactly placed under the embroidery needle, the computer stops rotation of stepping motors, all together, or one at a time, whatever command is given by the computer.

Now, under the next command two lock nuts 47 and 53 are engaged by two actuators 52 and 58 through the linkage, parts 51, 50, 49, 48 and 56, 57, 55, 54 correspondingly. Both nuts 47 and 53 are turned on driving screws 15 and 20 until they press back flat faces to the adjacent front faces of two lead nuts 16 and 21, taking out any clearances and/or backlash between the lead nuts 16, 21, and their driving screws 15, 20, correspondingly.

As a result, two plates 17 and 22 will be held without any free play in an unshakeable rigid position with respect to plate 13, and also regarding the table plate 2 (FIG. 1). It will continue as long as two actuators 52 and 58 are engaged under computer command to hold the nuts 47 and 53 in the locked position.

Now, only two stepping motors 25 and 36 are required to move the hoop assembly 44 and 45 under the head. In this way the first letter "I" will be embroided.

Under computer command the driving motor 5 moves the needle bar 4 (FIG. 1) to make one or two stitchings at the top part of letter "I", and then the needle bar is stopped at the top position having the needle elevated out of the work piece.

The next computer command allows the stepping motors 25 and 36 to move the hoop assembly to the place to accept the next stitches without any noticeable interruption or interference between the stitches made at the first and at the second stitching positions. As soon as it is accomplished, the needle bar is lifted again to allow the stepping motors 25 and 36 to move the hoop to the third stitching position. This sequence of operations will continue until the letter "I" is finished.

Letter "I" must occupy only the small part of the area to be monogrammed, however, this letter may occupy almost all, or a great part of the area covered by the operational range of the second band assembly, that is controlled by motions of stepping motors 25 and 36. Due to relatively small linear dimensions involved, the mechanical transmission disclosed by the invention should have a very small combined backlash to allow precise movements between stitches to produce a very fine embroidery pattern with a high quality and minimum interferences between adjacent stitchings. This apparatus should minimize this consumption of embroidery thread, and also increase the speed of embroidery operation.

The small dimensional range of the second band assembly together with new transmission commands to stepping motor 36 should produce a low inertia mechanism that could be easily adapted for high speed operation without being overloaded by dynamic forces commonly generated during any embroidery operation.

As soon as the entire letter "I" is finished, the computer commands the power to unlock the nuts 47 and 53 by turning them by their linkages and actuators. A clearance between the lead nuts 16 and 21, regarding driving screws 15 and 20 correspondingly, will allow a free and easy rotation of both driving screws. Now the computer issues the power to rotate stepping motors 14 and 19 to place the work piece in position to start embroidery of the second letter, that is letter "N".

Motors 25 and 36 may be, or may be not engaged to place the hoop assembly for embroidery of letter "N", so this motion could be accomplished by engaging only two motors, 14 and 19, or by engaging all four motors: 14, 19, 25, and 36. In either case the process could go at the same speed or even quicker and with the same quality.

As soon as the starting position for the second letter is reached, two actuators 52 and 55 are engaged to lock the nuts 16 and 20. Then the embroidery process goes in the same way as in the case of the letter "I", and during this process only two stepping motors 25 and 36 are used to change the position of hoop assembly 44–45 under the needle bar 4.

The said embroidery process goes on until the word INDEPENDENT is accomplished. Then the nuts 47 and 53 are unlocked, all four stepping motors are engaged to move the hoop to the position to start the next letter on the second line "S".

During the said operation the improved two band pantograph produces embroidery from one letter to another, and from one line to another, with more speed than is possible by utilizing only a one band assembly. Also, improved pantograph will produce embroidery on a large area, which is impossible to cover by a one band pantograph having the same speed and quality of embroidery operation. On the third line the described process goes to monogram the word COMPANY in the same way as the second word SCIENCE was produced. As the last letter "Y" of the last word is fininshed, the driving motor 5 is stopped, the needle bar is fixed when it is elevated, a signal is engaged that embroidery process is complete.

This process could be arranged in any reasonable order as a patern designer may wish. For example, in the same text the letter "Y" can be chosen as the first one to be monogrammed. letter "I" in the word INDEPENDENT could be chosen for final operations. Also, the word "SCIENCE" could be chosen to be the first, or to be the last in preparation of embroidery operations. Any large and complicated pattern should be presented as a combined set of small parts, and those small areas should be covered by the range of the second band assembly.

The work to move the hoop from one area to another is better programmed for first band operation only. This will simplify much adjustment and maintenance work on the embroidery machine resulting in negligable loss in average operational speed.

I claim:

1. An embroidery pantograph having a stationary plate of a first assembly fixed to an embroidery machine table, and having a first stepping motor controlled by a computer, said stepping motor having an output shaft to be rotated at proper times in one or another direction as required to form an embroidery pattern design by moving a work piece under a machine needle according to a specific pattern that is pre-recorded in a computer memory, said first stepping motor being fixed to one edge of said stationary plate and being connected to a first driving screw; said first driving screw being rotatably supported on another edge of the stationary plate and being coupled to a first lead nut which can reciprocate along said first driving screw during rotation motion generated by said first stepping motor; said first lead nut being fixed to a first movable plate having a set of low friction means to support said first movable plate on top of said first assembly; a second stepping motor being fixed to said first movable plate and having operational features similar to said first stepping motor, said second stepping motor being connected to a second driving screw; said second driving screw being rotatably supported on another edge of said first movable plate and also being coupled with a second lead nut; said second lead nut being capable of reciprocation along said second driving screw during rotary motion generated by said second stepping motor; said second lead nut being fixed to a second movable plate serving as a base for a second assembly, said second movable plate having a set of low friction means to provide support therefor on said first movable plate, said second movable plate being connected to a central block by elements including third and fourth stepping motors having operation features similar to said first and second stepping motors; a set of transmission means to convert rotary motion of output shafts of said third and fourth motors into reciprocating motion of said central block along rectangular X-Y coordinates; low friction means to provide a movable support for said central block with respect to said second movable plate; said central block being connected to a solid bracket with a holding assembly to fix a work piece to be embroidered.

2. The embroidery pantograph as claimed in claim 1, wherein two lock nuts are coupled with said first and second driving screws; said lock nuts being connected by mechanical linkages to a set of controlled actuators so as to permit turning of said lock nuts in both directions; said lock nuts being located close to said lead nuts, and in locked position both lock nuts being pressed against the faces of said lead nuts.

3. The embroidery pantograph as claimed in claim 1, wherein pulleys are associated with movable blocks on said second assembly.

* * * * *